US005492245A

United States Patent [19]

Kalkanis

[11] Patent Number: 5,492,245

[45] Date of Patent: Feb. 20, 1996

[54] ANTI-BULGING CONTAINER

[75] Inventor: Petros Kalkanis, Scala, Italy

[73] Assignee: The Procter & Gamble Company, Cincinnati, Ohio

[21] Appl. No.: 343,596

[22] PCT Filed: May 13, 1993

[86] PCT No.: PCT/US93/04580

§ 371 Date: Nov. 30, 1994

§ 102(e) Date: Nov. 30, 1994

[87] PCT Pub. No.: WO93/24377

PCT Pub. Date: Dec. 9, 1993

[30] Foreign Application Priority Data

Jun. 2, 1992 [EP] European Pat. Off. ..... 92201566

[51] Int. Cl.[6] ..... B65D 6/34

[52] U.S. Cl. ..... 220/609

[58] Field of Search ..... 220/609, 608

[56] References Cited

U.S. PATENT DOCUMENTS 3,409,167 11/1968 Blanchard .

4,120,419 10/1978 Saunders .

4,147,271 4/1979 Yamaguchi .

4,177,746 12/1979 Lee, Jr. et al. .

4,408,698 10/1983 Ballester .

4,542,029 9/1985 Caner et al. .

*Primary Examiner*—Joseph M. Moy

*Attorney, Agent, or Firm*—Ronald W. Kock; T. David Reed

[57] ABSTRACT

A container (1) of thermoplastic material comprising a side wall (2) and a base (3), said base comprising in a cross section in a plane comprising the container's vertical axis (A), a concave inwards curved section (4) connected to the side wall (2), at least two successive stairs, each stair consisting of a straight part (5,5') forming an angle (α1, α2) with a plane (B) perpendicular to said axis (A), followed by a sharp concave outwards curve (6,6'), and a dome (8) consisting of a smooth concave outwards curve, said base (3) being symmetrical about said axis (A).

7 Claims, 1 Drawing Sheet

ANTI-BULGING CONTAINER

FIELD OF THE INVENTION

The present invention relates to a container of thermoplastic material for containing liquids. The container is designed so as to resist bulging.

BACKGROUND OF THE INVENTION

It is well known in the art to use thermoplastic materials to manufacture containers for liquids. Some of the liquids to be contained by such containers, for instance bleach-containing compositions, create internal pressure which builds up with time. In such cases, the containers are progressively subjected to deformation due to the internal pressure build-up, especially at their base. This phenomenon is often referred to as "bulging". This phenomenon is especially acute in warm countries where the containers may be exposed to particularly elevated temperatures. In some instances, bulging can be so severe so as to induce a base deformation which is such that the container can no longer stay in upright position. For instance in supermarkets, the containers may fall of the shelves.

Anti-bulging containers have been disclosed in the art, for instance in DE 16 07 895, DE 21 11 534, EP 0 002 082 and our co-pending European Application EP 91202524. These references disclose containers having a central dome, where the dome is connected to the side walls of the container by pieces of thermoplastic material of various shapes. It is therefore an object of the present invention to provide a container of thermoplastic material for containing liquids with improved resistance to bulging.

It is also an object of the present invention to provide a solution to bulging which is particularly applicable to containers of smaller size.

The problem of bulging can to some extent be addressed by increasing the quantity of thermoplastic material used, so as to manufacture a container with thick walls. However, this solution is quite objectionable from an environmental point of view as well as from an ease of manufacturing viewpoint. It is therefore an another object of the present invention to provide an anti-bulging container of thermoplastic material having walls of minimum thickness.

SUMMARY OF THE INVENTION

The present invention is a container (1) of thermoplastic material comprising a side wall (2) and a base (3), said base comprising, in a cross section in a plane comprising the container's vertical axis (A), a concave inwards curved section (4) connected to the side wall (2), at least two successive stairs, each stair consisting of a straight part (5,5') forming an angle (α1, α2) with a plane (B) perpendicular to said axis (A), followed by a sharp concave outwards curve (6,6'), and a dome (8) consisting of a smooth concave outwards curve. The base (3) of the container (1) is symmetrical about said axis (A).

DETAILED DESCRIPTION OF THE INVENTION

The container according to the invention is made of a thermoplastic material. Such materials have been extensively described in the art and include vinyl chloride based resins, polymers and copolymers derived from olefins, acrylic polymers and copolymers, polyethylene, polypropylene, polystyrene, polyethylene terephthalate, polyethylene terephthalate glycol, or mixtures thereof. The container can be made by single or multi layer extrusion of such materials. It can also be made out of recycled thermoplastic materials. A preferred thermoplastic material for use herein is polyethylene.

The cross section of the container according to the present invention, and/or its base, in a plane perpendicular to the container's vertical axis (A), can be square or rectangular, ovoid or circular. Furthermore, the base (3) of the container according to the present invention is symmetrical about said axis (A). In a preferred embodiment of the invention, said cross section is circular. The present invention is particularly suitable for containers of rather small size, i.e. where the container's largest dimension in said cross section is less than 10 cm.

Figure 1:
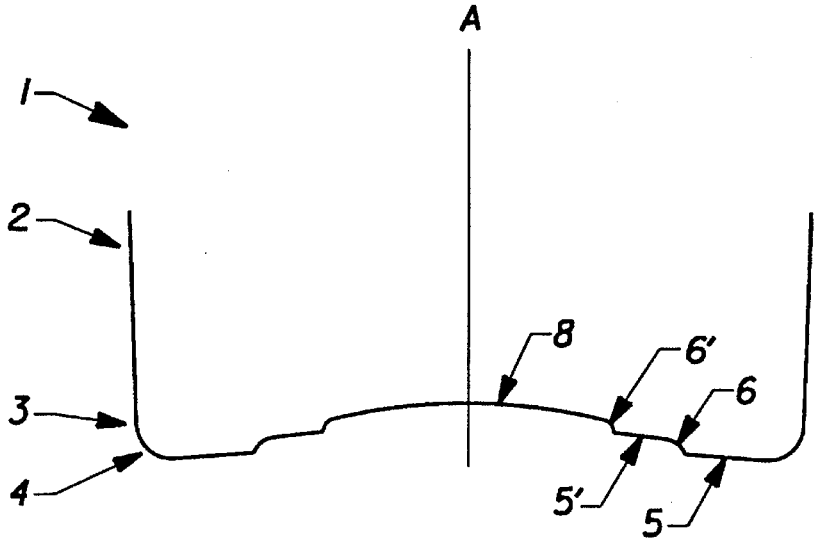
Figure 2:
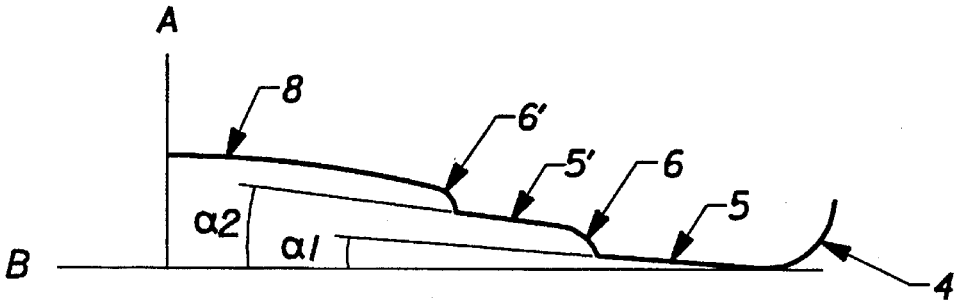

The following description refers to FIG. 1 which represents the lower part of the container in a cross section in a plane comprising the container's central vertical axis (A). FIG. 2 represents a scale up of the lower part of the container, on one side of (A).

The container (1) according to the present invention comprises a side wall (2) and a base (3). The base (3) which is the gist of the present invention is connected to the side wall (2). The base (3) comprises a curved section (4), followed by at least two stairs (5/6,5'/6') and a dome (8).

The curved section (4) is connected at one extremity to the side wall(2), and at the other extremity to at least two successive stairs. The curve of said curved section (4) is concave inwards, i.e. the interior of said curve faces the inside of the container.

Each stair comprises a straight part (5,5') followed by a sharp curve (6,6'). The straight parts (5,5') can be of same dimensions, but in a preferred embodiment, the straight part which is the closest to the periphery of the container is longer than straight part which is closest to the center of the container. Each straight part (5,5') forms an angle (α1, α2) with a plane (B) perpendicular to the container's vertical central axis (A). According to the present invention, α1 and α2 can be different, but in a preferred embodiment of the invention α1 and α2 are the same. Each straight part (5,5') is connected to a sharp curve (6,6'). By sharp curve, it is meant herein a curve who's radius is smaller than the radius of the curved section (4), said sharp curves (6,6') are concave outwards, i.e. the interior of each sharp curve (6,6') faces the outside of the container. The radius of the sharp curves (6,6') can be identical, but in a preferred embodiment, the radius of the sharp curve which is closest to the periphery of the container is larger than the radius of the sharp curve which is closest to the center of the container. In a preferred embodiment of the present invention, the base (3) only comprise two stairs.

The sharp curve of the stair which is closest to the center of the container is connected to a dome (8). The dome (8)

consists of a smooth curve. Said smooth curve is concave outwards, i.e. the interior of said curve faces the outside of the container. By smooth curve, it is meant herein a curve who's radius is larger than the radius of both curved sections (6,6').

The present invention is further illustrated by the following example.

EXAMPLE

A cylindrical container according to the present invention is made out of polyethylene. It has a diameter of 90 mm. The radius of the curved section (4) is 5.5 mm. The length of the straight part (5) measured along plane (B) is 11.5 mm. The radius of the sharp curve (6) is 3 mm. The length of the straight part (5') measured along plane (B) is 4.65 mm. The radius of the sharp curve (6') is 2 mm. Finally, the radius of the dome is 90 mm. The thickness of the thermoplastic material used for this embodiment is 1.5 mm throughout the container.

I claim:

1. A container (1) of thermoplastic material comprising a side wall (2) and a base (3), said base comprising in a cross section in a plane comprising the container's vertical axis (A), a concave inwards curved section (4) connected to the side wall (2), at least two successive stairs, each stair consisting of a straight part (5,5') forming an angle ($\alpha 1$,$\alpha 2$) with a plane (B) perpendicular to said axis (A), followed by a sharp concave outwards curve (6,6'), and a dome (8) consisting of a smooth concave outwards curve, said base (3) being symmetrical about said axis (A).

2. A container according to claim 1 which has a larger dimension in a cross section in a plane perpendicular to the container's central vertical axis of less than 10 cm.

3. A container according to claim 1 which has a circular cross section in a plane perpendicular to the container's central vertical axis.

4. A container according to claim 1 comprising only two stairs

5. A container according to claim 1 where $\alpha 1=\alpha 2$.

6. A container according to claim 1 wherein the straight part (5) which is closest to the periphery of the container is longer than the straight part (5') which is closest to the center of the container.

7. A container according to claim 1 where the radius of the sharp concave outwards curve (6) which is closest to the periphery of the container is larger than the radius of the sharp concave outwards curve (6') which is closest to the center of the container.

* * * * *